US007210534B2

(12) United States Patent
Hayter et al.

(10) Patent No.: US 7,210,534 B2
(45) Date of Patent: May 1, 2007

(54) LOCK FOR A DOWNHOLE TOOL WITH A RESET FEATURE

(75) Inventors: Steven R. Hayter, Houston, TX (US); William N. Triplett, Spring, TX (US); Toby J. Begnaud, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 347 days.

(21) Appl. No.: 10/796,593

(22) Filed: Mar. 9, 2004

(65) Prior Publication Data

US 2005/0199399 A1 Sep. 15, 2005

(51) Int. Cl.
*E21B 34/08* (2006.01)
*E21B 43/00* (2006.01)

(52) U.S. Cl. ..... 166/386; 166/323; 166/240; 166/334.1; 166/242.7

(58) Field of Classification Search ..... 166/386, 166/323, 240, 334.1, 242.7
See application file for complete search history.

(56) References Cited

U.S. PATENT DOCUMENTS

| | | | | | |
|---|---|---|---|---|---|
| 2,894,586 | A * | 7/1959 | Schramm et al. | ..... | 166/125 |
| 3,207,222 | A * | 9/1965 | Tamplen | ..... | 166/136 |
| 3,762,471 | A | 10/1973 | Mott | | |
| 3,786,866 | A * | 1/1974 | Tausch et al. | ..... | 166/322 |
| 3,821,962 | A * | 7/1974 | Mott | ..... | 137/12 |
| 3,856,081 | A * | 12/1974 | Canalizo | ..... | 166/123 |
| 4,062,406 | A * | 12/1977 | Akkerman et al. | ..... | 166/323 |
| 4,306,623 | A * | 12/1981 | Brooks | ..... | 166/322 |
| 4,356,867 | A * | 11/1982 | Carmody | ..... | 166/373 |
| 4,403,659 | A | 9/1983 | Upchurch | | |
| 4,550,780 | A * | 11/1985 | Mott | ..... | 166/323 |
| 4,667,743 | A * | 5/1987 | Ringgenberg et al. | ..... | 166/321 |
| 4,967,845 | A * | 11/1990 | Shirk | ..... | 166/386 |
| 5,518,073 | A * | 5/1996 | Manke et al. | ..... | 166/240 |
| 5,826,657 | A * | 10/1998 | Ringgenberg | ..... | 166/336 |
| 6,513,595 | B1 * | 2/2003 | Freiheit et al. | ..... | 166/332.4 |
| 2002/0066573 | A1 * | 6/2002 | Patel | ..... | 166/374 |
| 2002/0112862 | A1 * | 8/2002 | Patel | ..... | 166/386 |
| 2004/0238185 | A1 * | 12/2004 | Rothers et al. | ..... | 166/382 |

* cited by examiner

*Primary Examiner*—Jennifer H Gay
(74) *Attorney, Agent, or Firm*—Steve Rosenblatt

(57) ABSTRACT

The lock allows two members in a downhole tool to be temporarily held together. In an application where mandrel movement is dictated by pressure cycling in combination with a J-slot mechanism, such as in a downhole valve, the mandrel is releaseably retained to an adjacent connector against mechanical impacts. The mandrel features an extended collet that moves relatively to a floating sleeve during pressure cycles. At some point the collet heads rise to an elevated groove that causes them to contact a no-go shoulder for locking. The lock is defeated be removing the collet heads from the elevated groove for normal tool operation.

20 Claims, 17 Drawing Sheets

LOCK FOR A DOWNHOLE TOOL WITH A RESET FEATURE

FIELD OF THE INVENTION

The field of the invention is locks for downhole tools that can selectively retain the tool in a position for a particular operation and more particularly locks that can be released and subsequently reset for holding a downhole tool for subsequent operations.

BACKGROUND OF THE INVENTION

There are many types of tools used downhole. Some tools are moved repeatedly between positions for the performance of different operations. While these tools are designed to shift between the positions to accomplish downhole functions, the procedures downhole vary with time and tools that readily performed functions in multiple positions reveal a potential shortcoming. One such shortcoming can be the inability to retain a desired position throughout the duration of a particular downhole operation. In the past, locking the tool in a particular position has been tried, but those attempts created additional operating limitations. Some locks were effective against pressure variations but were not effective in resisting mechanical impacts. Some locks, when actuated hydraulically, permanently held a position of the downhole tool and could not be released.

What was needed was a lock for a downhole tool that could fix its position for a time to allow a certain procedure to take place and that could thereafter be released to allow the tool to operate in its various positions for other purposes.

The context that suggested such a desired lock assembly was a downhole tool known as a downhole valve and more specifically a model 'RB' Valve offered by Baker Hughes Incorporated. This downhole valve featured a J-slot mechanism between a sleeve and a mandrel. Pressure in the tubing could be cycled back and forth enough times to operate the J-slot mechanism until the mandrel, upon relief of applied pressure after a predetermined amount of cycles, could move a certain distance to allow the valve to go to the open position. In this example the valve was a ball that rotated 90°. Since this valve was actuated with pressure cycles in the tubing, it could be affected by pressure spikes in the tubing. Also, it was susceptible to mechanical impacts on the mandrel that could operate the valve out of the desired position for a specific procedure. One way this could happen is a tool string running through the mandrel could drag it to the next indexing position. Competing valves that operated on hydraulic cycling in combination with a J-slot mechanism would allow the valve to go to the open position and be locked there, but the lock was permanent so the valve could not later be closed.

Some operators, particularly in deep water, have high cost completions that need a lock that can be reset to allow injection of fluids through an open valve at high rates without concern that such a procedure will operate the valve out of an open position. Additionally, such a re-settable lock could accommodate tool strings with tight clearances to pass through without risk of moving the valve out of the desired position. Such a lock would then allow the valve position to be shifted when the specific operation that required the valve position to be locked is concluded.

Those skilled in the art will more readily appreciate the multiple applications of the described preferred embodiment below in a variety of downhole applications. In the preferred embodiment, the lock can hold members that otherwise move relatively with respect to each other when the tool changes positions to perform different functions. The relative movement can occur in one or more directions.

Many tester valves operate with annulus pressure cycles and are not vulnerable to tubing pressure spikes. The 'RB' Valve has some similar operating characteristics to tester valves except that it cycles on application of tubing pressure. Tester valves with J-slot mechanisms are illustrated in U.S. Pat. No. 4,667,743. A hydraulically triggered resetting lock for a tester valve that selectively disables the drive system for the mandrel is shown in U.S. Pat. No. 5,518,073. In this device, the valve can stay in the open position even with subsequent pressure cycling that can unintentionally occur. The mandrel is not mechanically restrained, rather, it is simply temporarily disabled from being further actuated by applied pressure until the drive system is again enabled. Also of related interest are U.S. Pat. No. 4,403,659 and U.S. application 2002/0066573. U.S. application 2002/0112862 shows a tester valve that can be cycled a predetermined number of times before it locks permanently closed. One way this occurs is a ratchet lock as shown in FIG. 10 and another is with a collet that can jump a hump in only a single direction as shown in the lower end of the split view in FIG. 20.

Also of interest is U.S. Pat. No. 3,762,471 that uses dual control lines and a rotating ball in a subsurface safety valve that may be locked open when a sleeve attached to the ball is forced to move under hydraulic pressure so that the ball moves into the open position and a latch is also forced by hydraulic pressure to move to lock a detent into a recess. The lock can be released by pressure applied to different ports to liberate the detent from the recess. This complex design requires two control lines and due to its complexity was difficult to manufacture economically and was not commercially successful. It also required independent movement of a latch apart from the member that operates the ball to the open position to accomplish the locking. Also related to this design is U.S. Pat. No. 4,550,780 that featured a ball type subsurface safety valve that could be locked open and released. This valve was capable of being unlocked by pressure applied to the tubing and for that reason could be subject to being unlocked by unexpected pressure surges in the tubing. Locking also required the insertion of a bridge. plug.

SUMMARY OF THE INVENTION

The lock allows two members in a downhole tool to be temporarily held together. In an application where mandrel movement is dictated by pressure cycling in combination with a J-slot mechanism, such as in a downhole valve, the mandrel is releaseably retained to an adjacent connector against mechanical impacts. The mandrel features an extended collet that moves relatively to a floating sleeve during pressure cycles. At some point the collet heads rise to an elevated groove that causes them to contact a no-go shoulder for locking. The lock is defeated be removing the collet heads from the elevated groove for normal tool operation.

DETAILED DESCRIPTION OF THE PREFERRED EMBODIMENT

The drawings illustrate the resetting lock mechanism in detail and omit most of the details of the operation of a tester valve that are known. While an 'RB' valve is used for illustrative purposes, the present invention can be deployed in a downhole application where it is desired to hold one member to another during a specific downhole operation and to allow the downhole tool to resume other operations at a later time.

In the preferred embodiment, the invention is deployed in an 'RB' Valve. Such a valve is frequently attached to a packer and employs a j-slot mechanism, which is cycled by virtue of alternating application and removal of pressure downhole. In the preferred embodiment, pressure cycling occurs in the tubing and the pressure cycles, after a predetermined number of cycles, allows a mandrel 10 to shift with respect to a stationary surrounding connector 12 so that the net result can be an alignment or misalignment of ports to selectively open or close the downhole valve. In normal operations of the downhole valve a certain number of pressure cycles will advance a pin in a J-slot, effectively shifting the mandrel 10 up and down each time but not far enough to change the valve position. In the preferred embodiment, the pressure cycles need to be repeated a predetermined number of times before release of the pressure will allow the valve to open. At this point the mandrel stays in the open position and is insensitive to pressure cycles in the tubing from subsequent operations. However, without the lock of the present invention such a valve was still susceptible to closing from mechanical impacts resulting from subsequent downhole operations through the mandrel. If it was possible to build a tubing/annulus pressure differential with the valve open, without the present invention, such as might occur if injecting through the valve at high flow rates, then the valve might partially close. At the same time, prior solutions that automatically locked a hydraulically functioned J-slot type downhole valve proved to be of limited use due to their inability to be re-closed. Accordingly, in the preferred embodiment, the lock provides the versatility of locking in the open position and preferably automatic lock actuation when achieving that position in combination with the ability to unlock so the valve can be returned to normal function where it can be closed and opened any number of times as conditions downhole require.

Figure 1A:
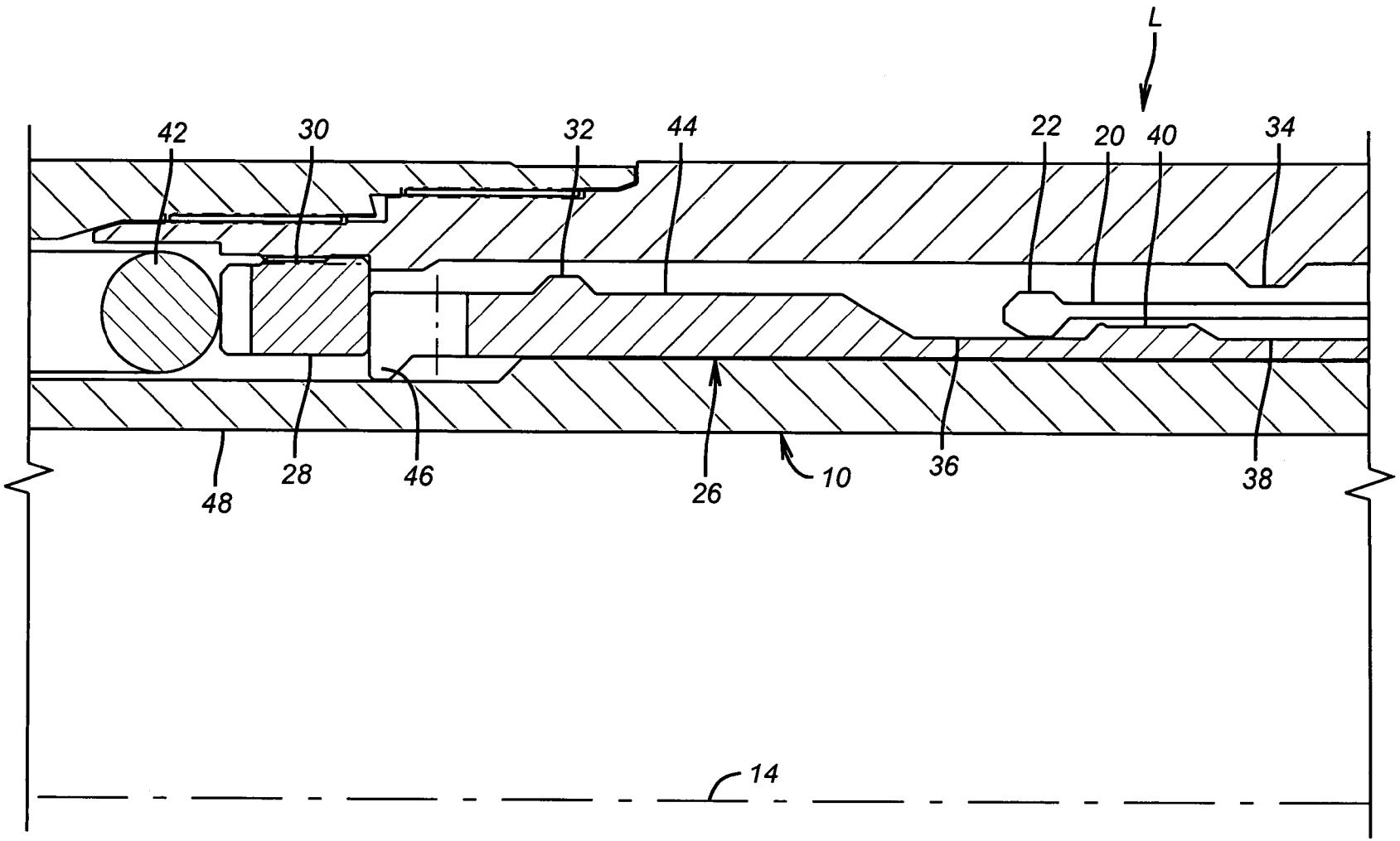
FIGS. 1*a*–1*b* are a sectional view of the lock components with the downhole tool, in this example a valve, in the closed position.
Figure 1B:
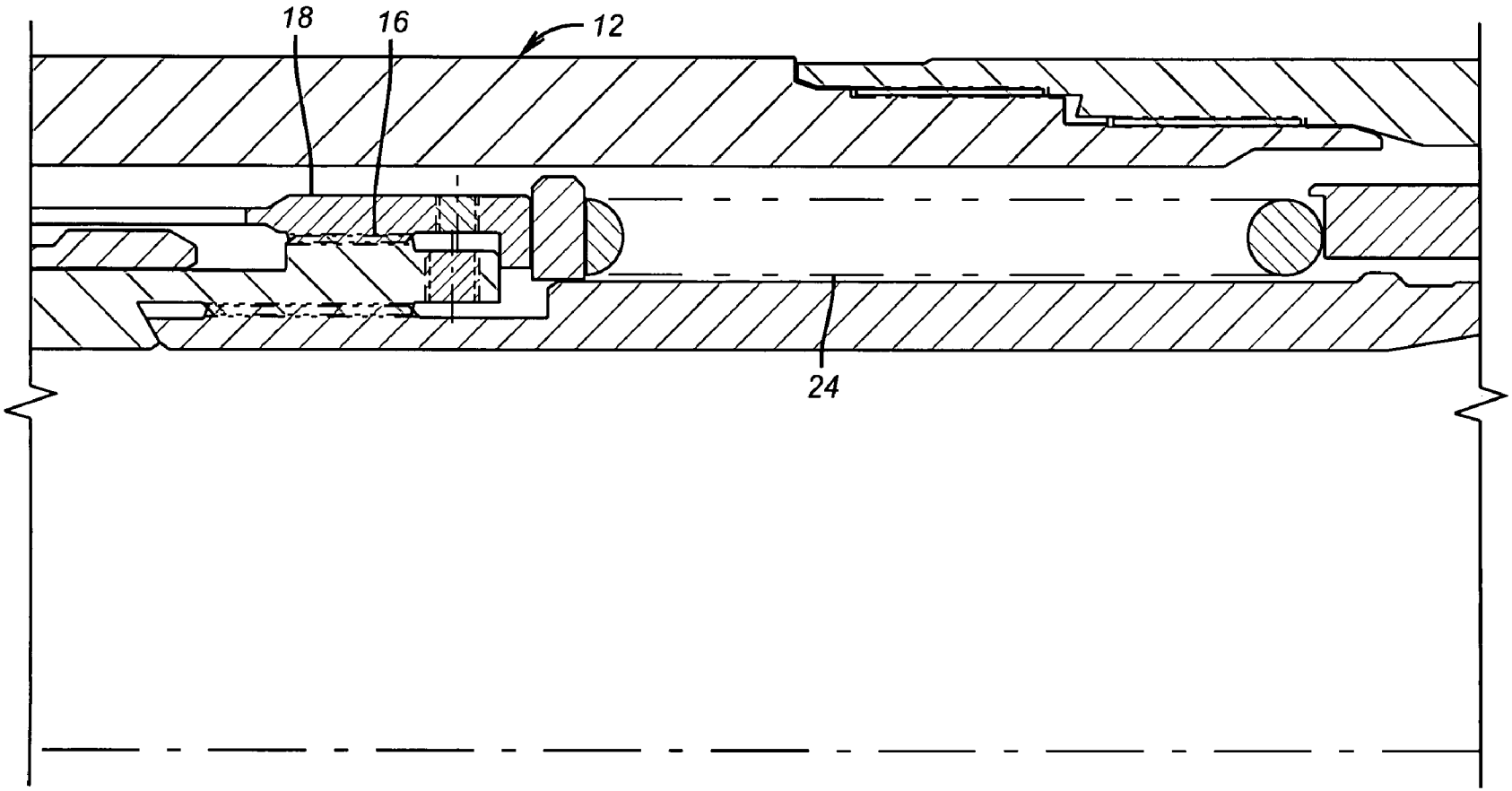

The workings of the lock of the present invention can be seen starting with FIG. 1. The mandrel 10 is operated by the J-slot mechanism (not shown) to move up and down. Those skilled in the art will appreciate that the mandrel 10 has a central axis 14 and it moves up and down responsive to pressure cycles, preferably in the annular space above the packer or other seal (not shown). The mandrel 10 is operated by a set of pistons and reciprocates but does not rotate. The reciprocating movement is controlled by a rotating sleeve with pins that travel in a J-slot pattern in the mandrel. 10. Attached to mandrel 10 at thread 16 is a collet ring 18 that has extending collet fingers 20 with each finger 20 having a collet head 22. The collet ring 18 is biased uphole by a spring 42. While the mandrel is mounted so that it can reciprocate responsive to applied pressure cycles, the surrounding connector 12 is fixedly mounted from the packer or seal above (not shown). Mounted between the connector 12 and the mandrel 10 is sleeve 26. The upper travel limit of sleeve 26 is defined by ring 28 attached at thread 30 to connector 12. The lower travel limit of sleeve 26 happens when a protrusion 32 also known as a no-go and which extends in a direction away from the axis 14 contacts a no-go 34 on connector 12 that is pointing toward the axis 14. Because of the connection at thread 16 the collet heads 22 move in tandem with mandrel 10. However, relative movement between the sleeve 26 and the mandrel 10 is possible if the sleeve is restrained by contact of no-go 32 with no-go 34.

Sleeve 26 has an upper groove 36, a lower groove 38 and a raised groove 40 between them. The collet heads 22 can travel past no-go 34 when they are aligned with either grooves 36 or 38. However, when the collet heads are aligned with raised groove 40 they can't clear no-go 36. When this happens, the lock L is operational. The lock L can be defeated by using a tool to liberate the mandrel 10 to move uphole under the force of spring 42.

It should be noted that sleeve 26 differs in design between the version shown in FIGS. 1–5 and that shown in FIG. 6. The design in FIG. 6 shows a greater wall thickness under raised groove 40 and is used primarily in the larger sizes. The added wall thickness is for added strength to deal with the anticipated loads imposed from collet heads 22 to prevent the sleeve 26 from deforming in that location under load. This feature is not found in the sleeve design of FIGS. 1–5 because in the smaller sizes the loads are lower thus avoiding the need for increasing the wall thickness under the raised groove 40.

Sleeve 26 is thicker at upper end 44 to give it strength against impact loads on the mandrel 10 with the no-go shoulders 32 and 34 in contact. Additionally, sleeve 26 has a small diameter 46 that extends into recess 48 to guide the movement of sleeve 26 and to prevent it from contorting if no-go shoulders 32 and 34 contact violently.

The operation of the lock L will now be described in detail. In FIG. 1 the tester valve (not shown) is in the closed position and no pressure is applied to the tubing. The sleeve 26 is against ring 28 and the collet heads 22 are in groove 36.

Figure 2A:
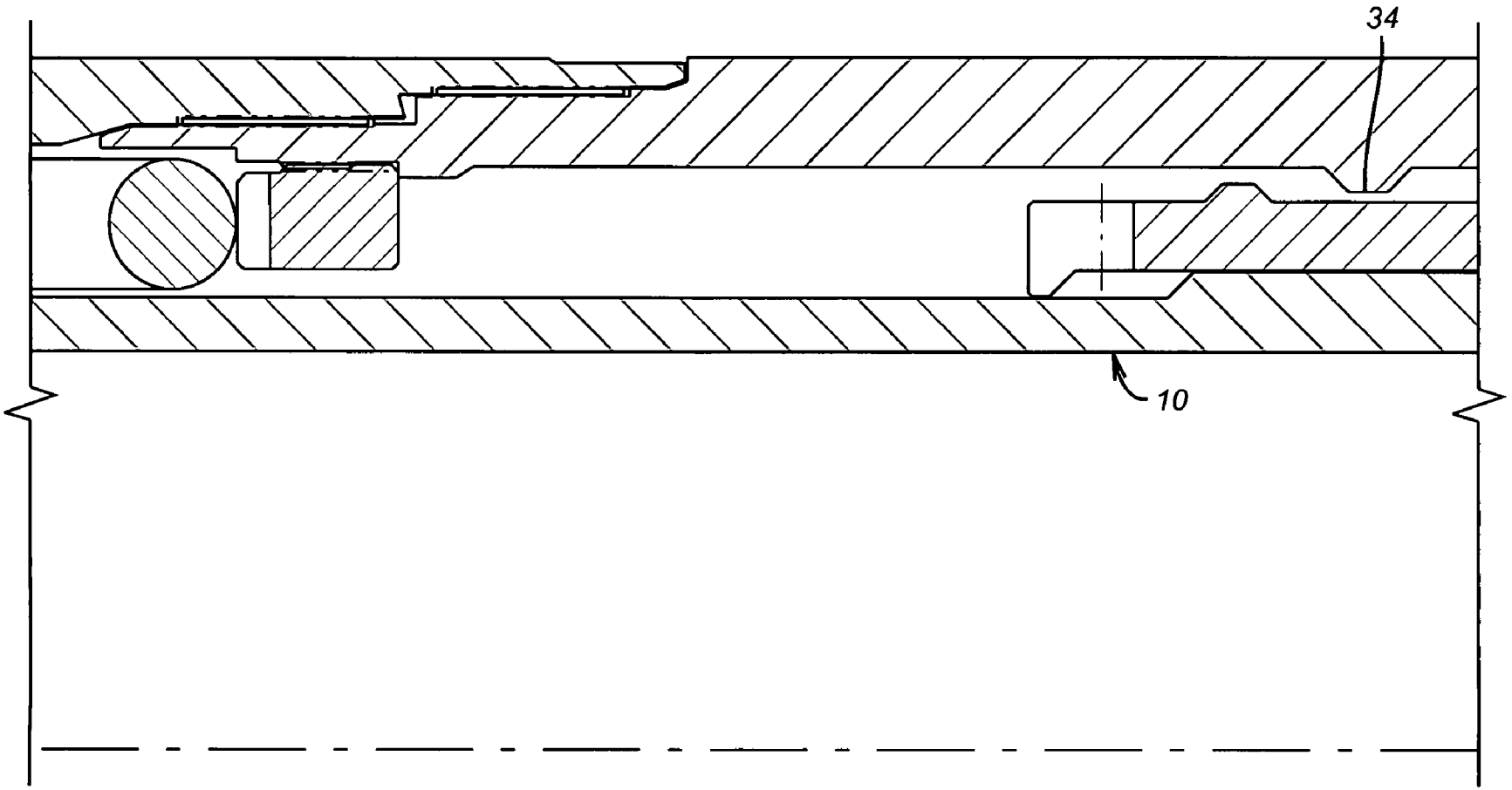
FIGS. 2*a*–2*b* are the view of FIG. 1 with the valve still closed but with pressure applied during an intermediate cycle.
Figure 2B:
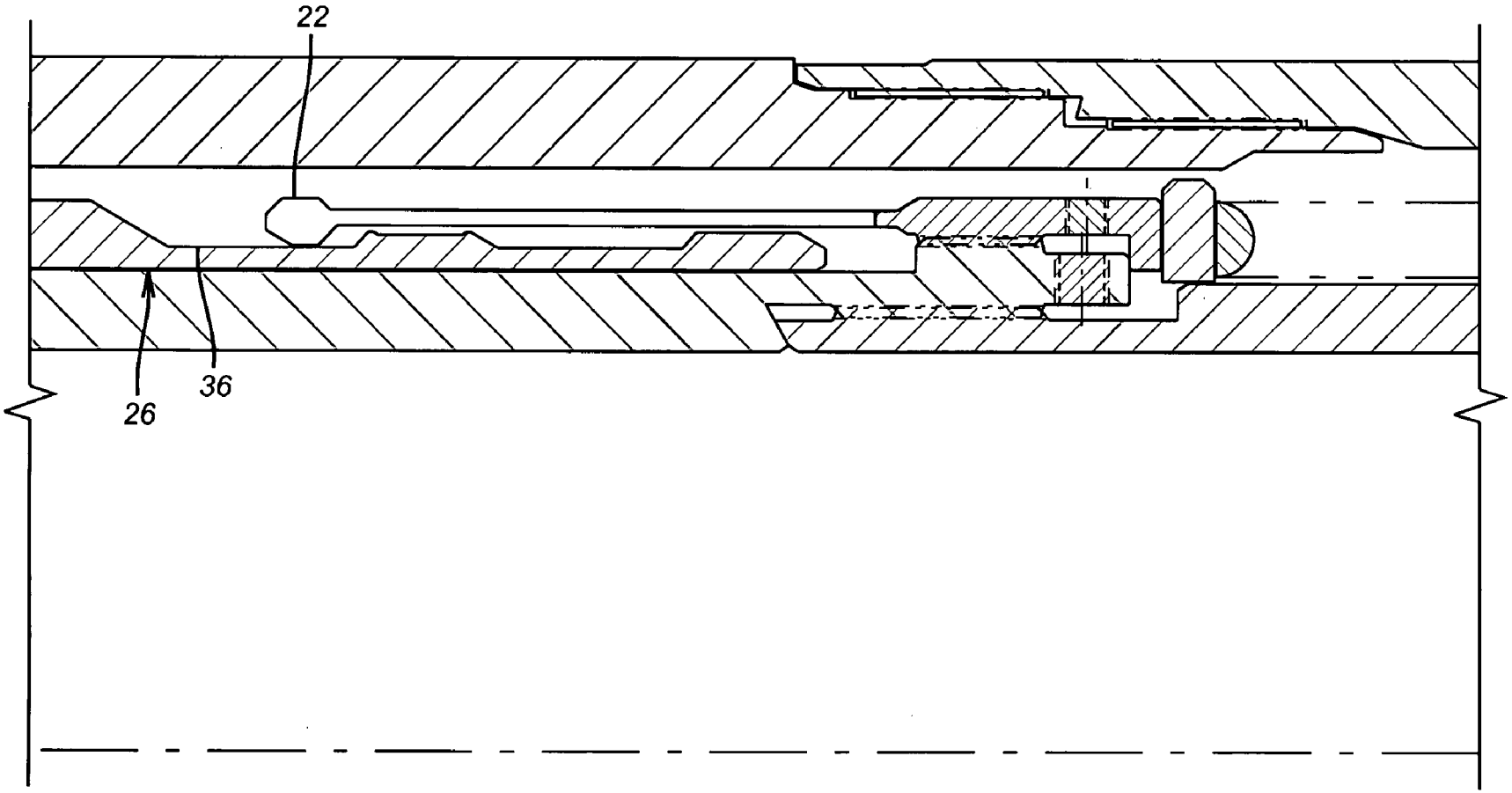
Figure 3A:
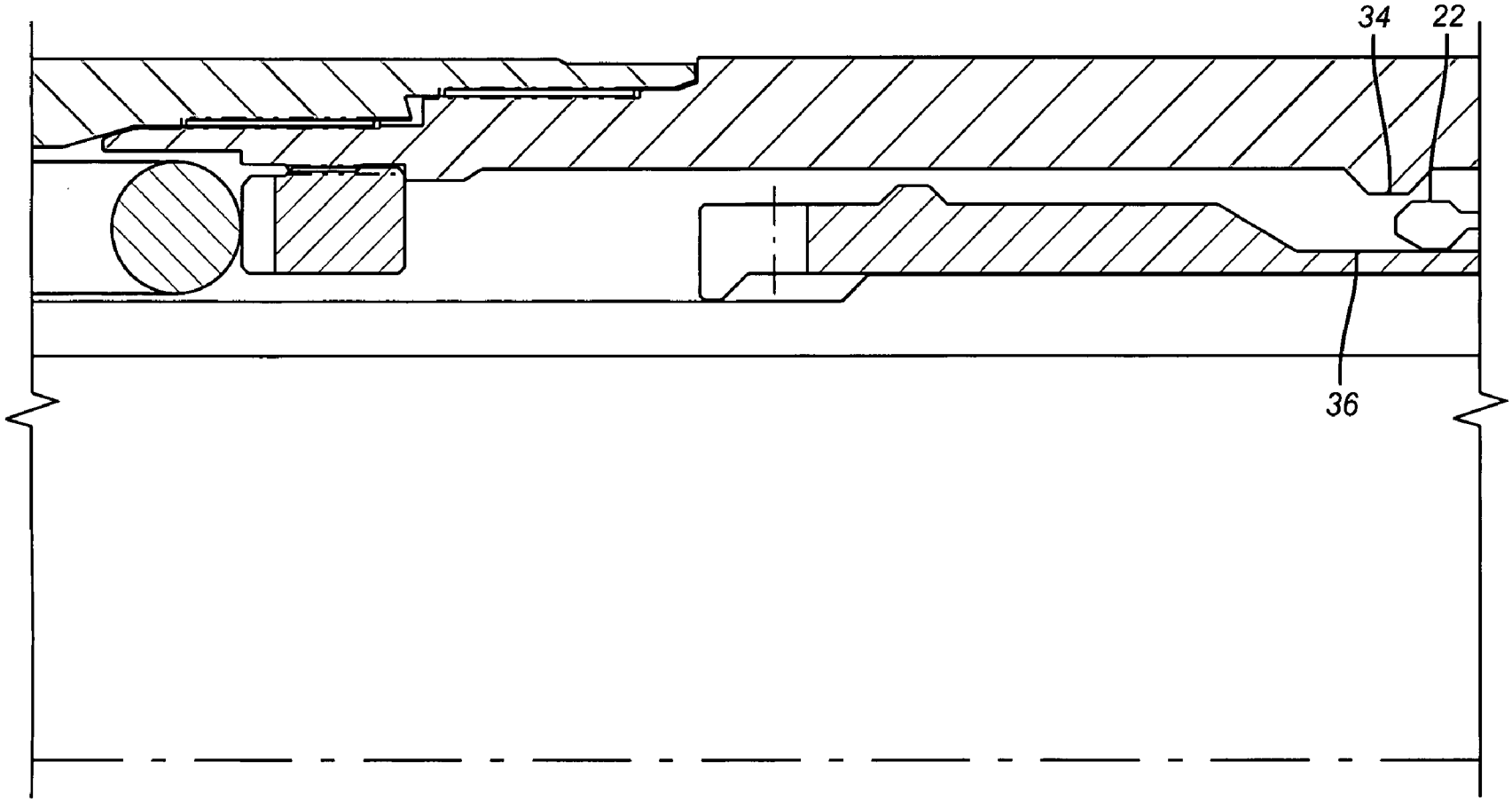
FIGS. 3*a*–3*b* are the view of FIG. 2 with the pressure removed but the valve is still closed.
Figure 3B:
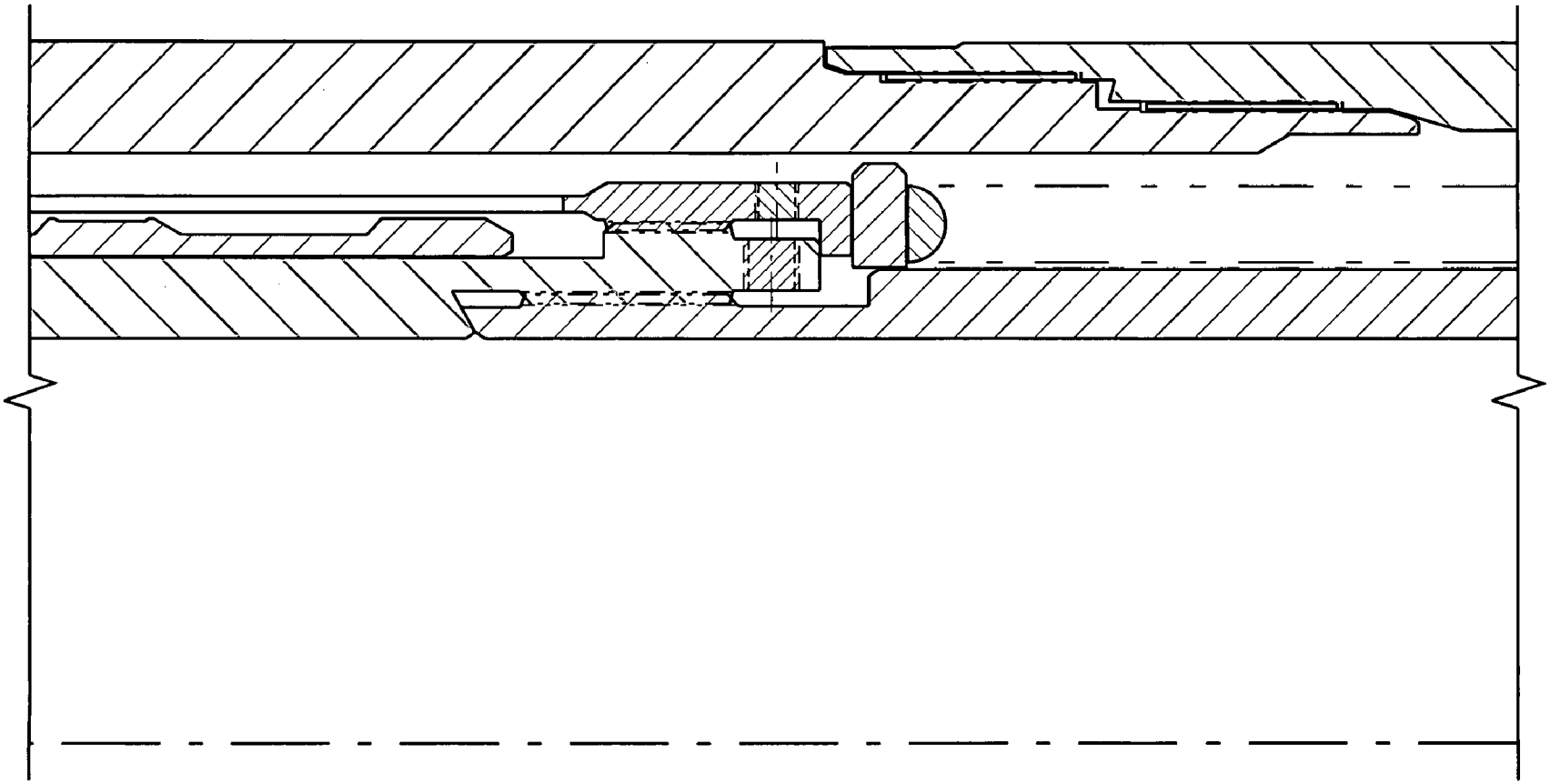

The procedure for opening the valve requires cycles of pressure to the tubing. In a particular design it may take 11 cycles of pressure where each time pressure is applied the lock L will go into position as shown in FIG. 2. In FIG. 2, the mandrel 10 has shifted down compared to the FIG. 1 position. The collet heads 22 remain in upper groove 36, as there has been no relative movement between the mandrel 10 and the sleeve 26. The collet heads 22 have cleared no-go 34 on the connector 12.

When the pressure is released in each of the 11 cycles referred to above, springs 42 and 58 urge the mandrel 10 uphole and up with it go the collet heads 22 still in upper groove 36. The collet heads do not rise above no-go 34 but as previously mentioned, when they are in groove 36 they are capable of clearing no-go 34.

Figure 4A:
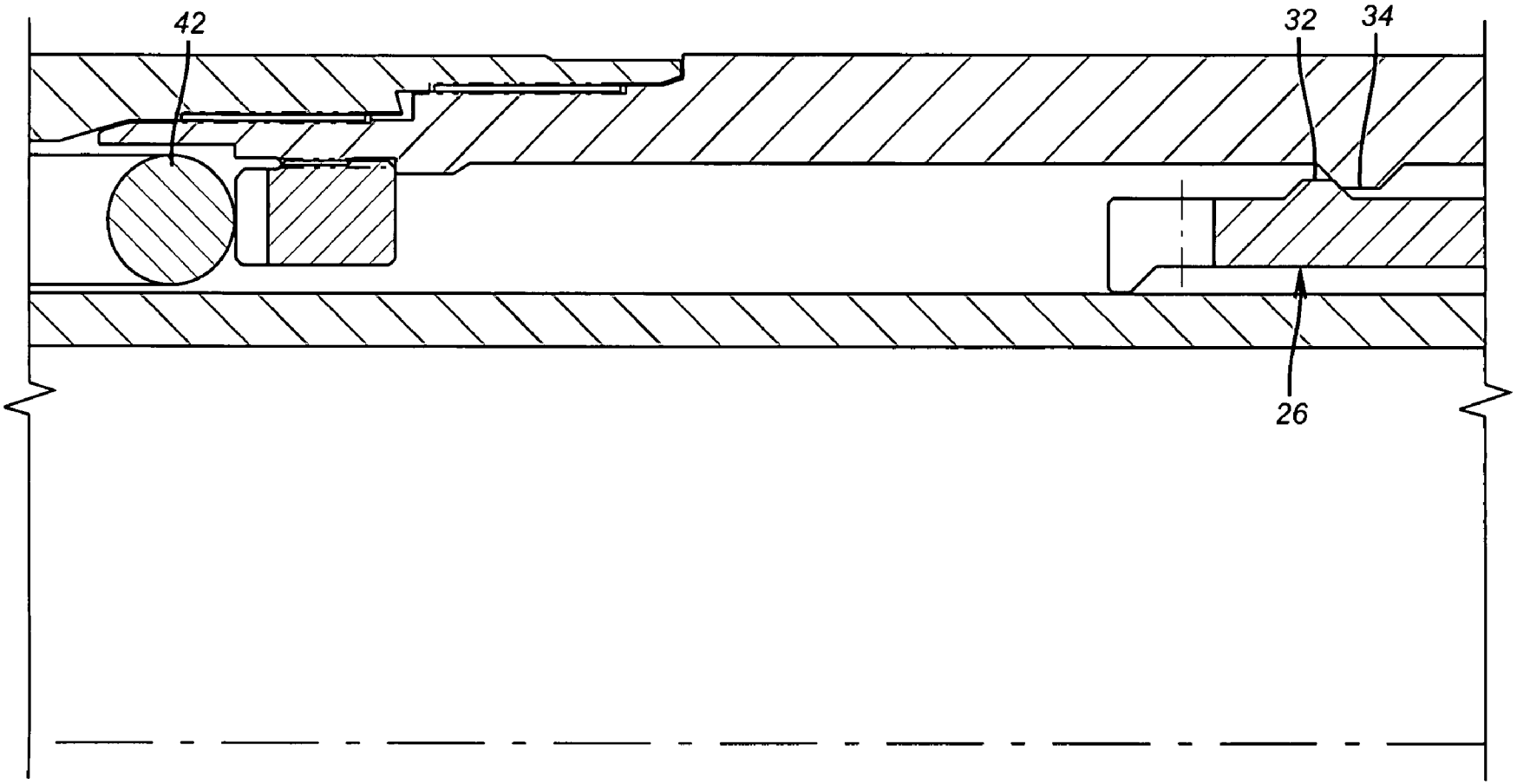
FIGS. 4*a*–4*b* are the view of FIG. 3 with pressure reapplied causing the collet heads to jump from the upper groove to the lower groove and pass over the raised groove.
Figure 4B:
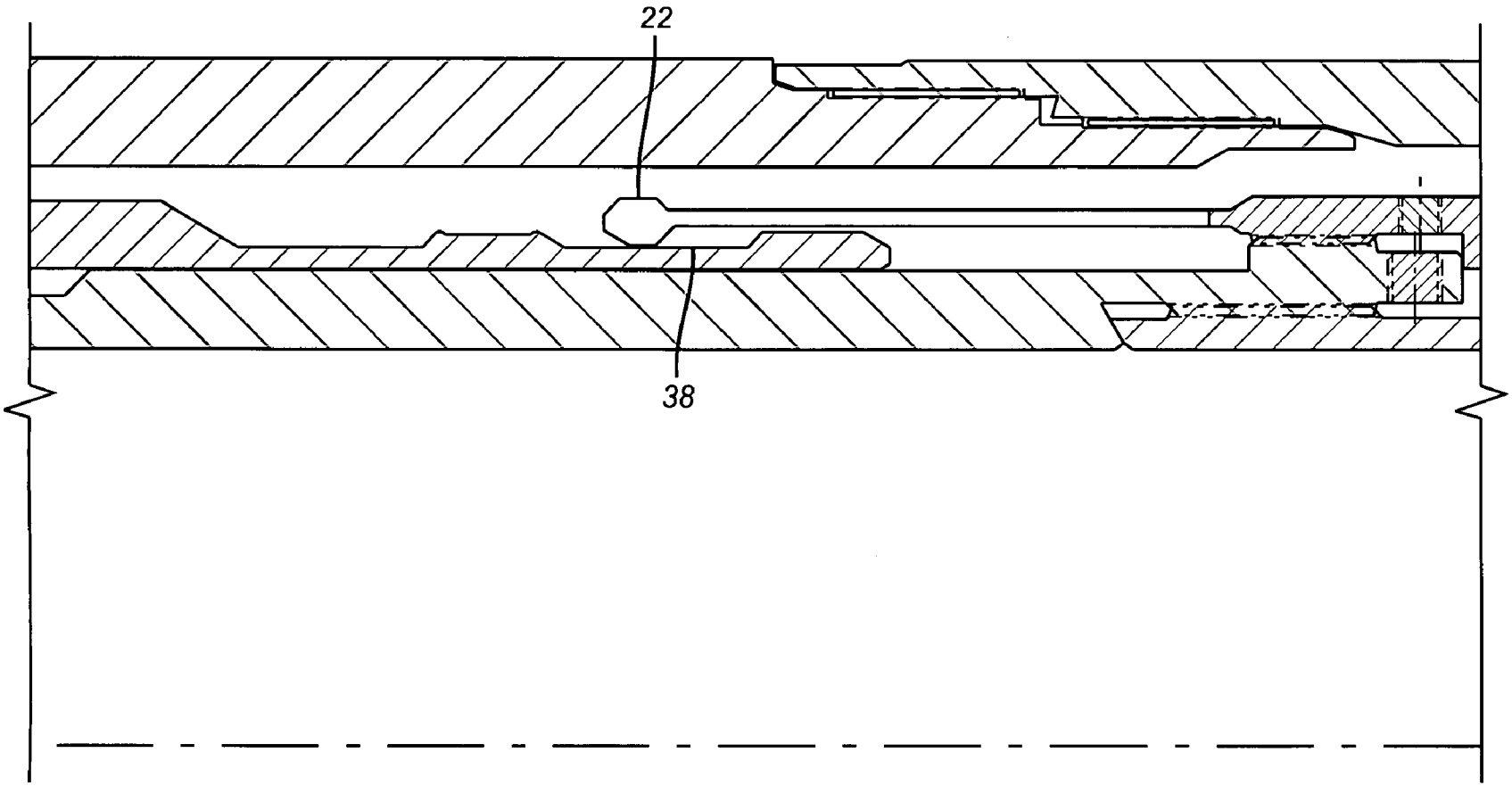
Figure 5A:
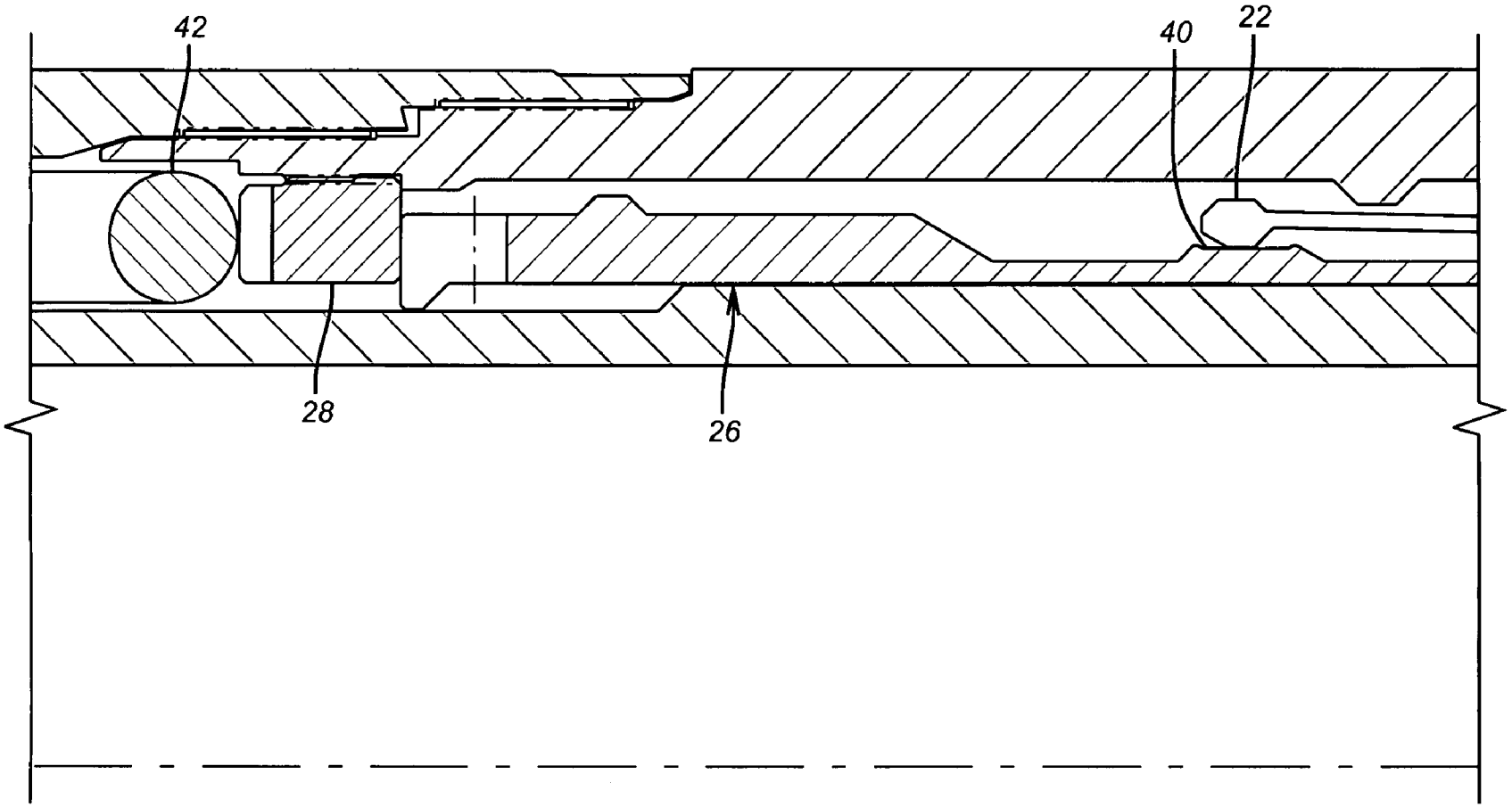
FIGS. 5*a*–5*b* show the pressure removed to put the valve in the open position and secure the lock with the collet heads on the raised groove.
Figure 5B:
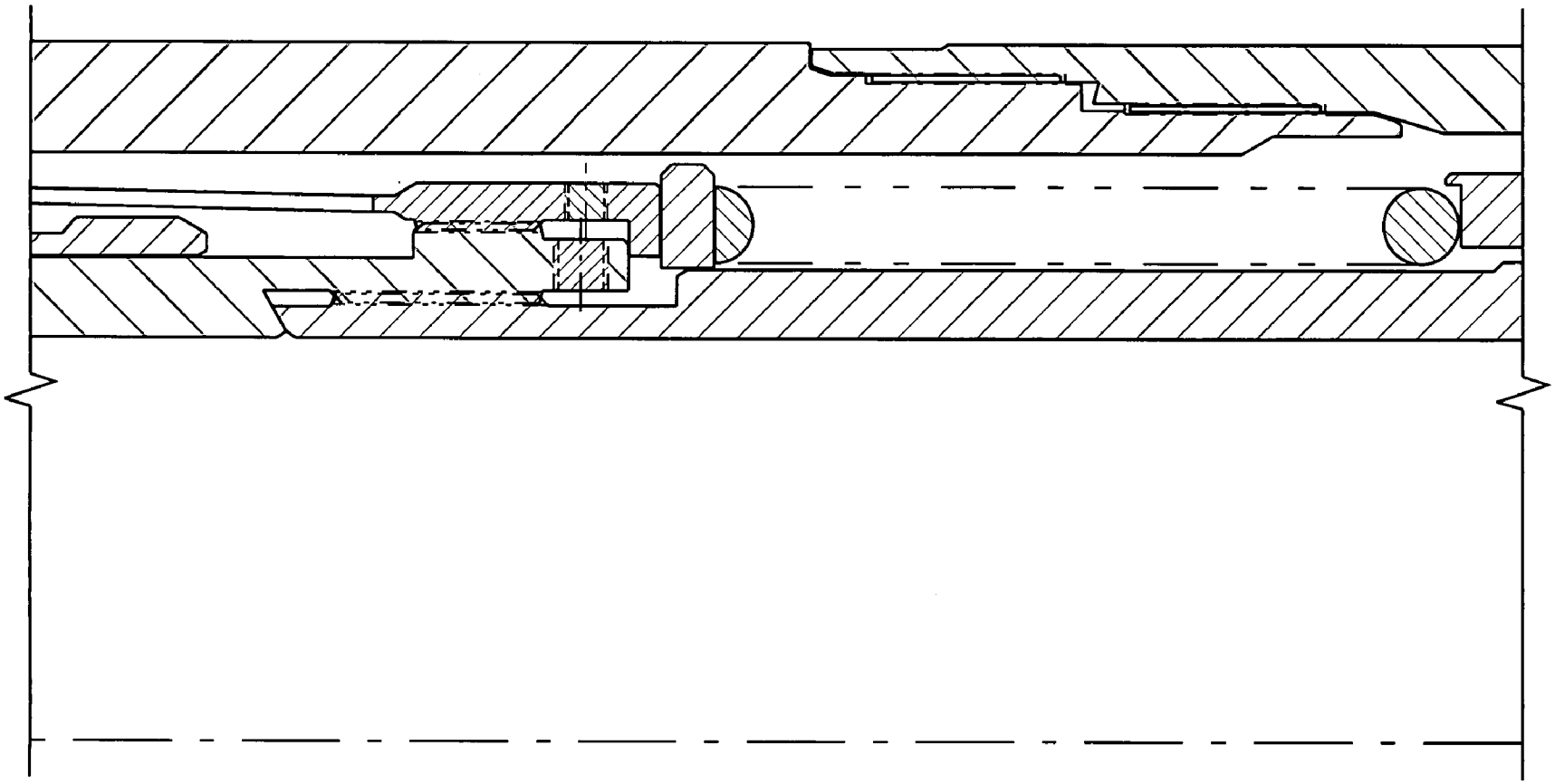
Figure 6A:
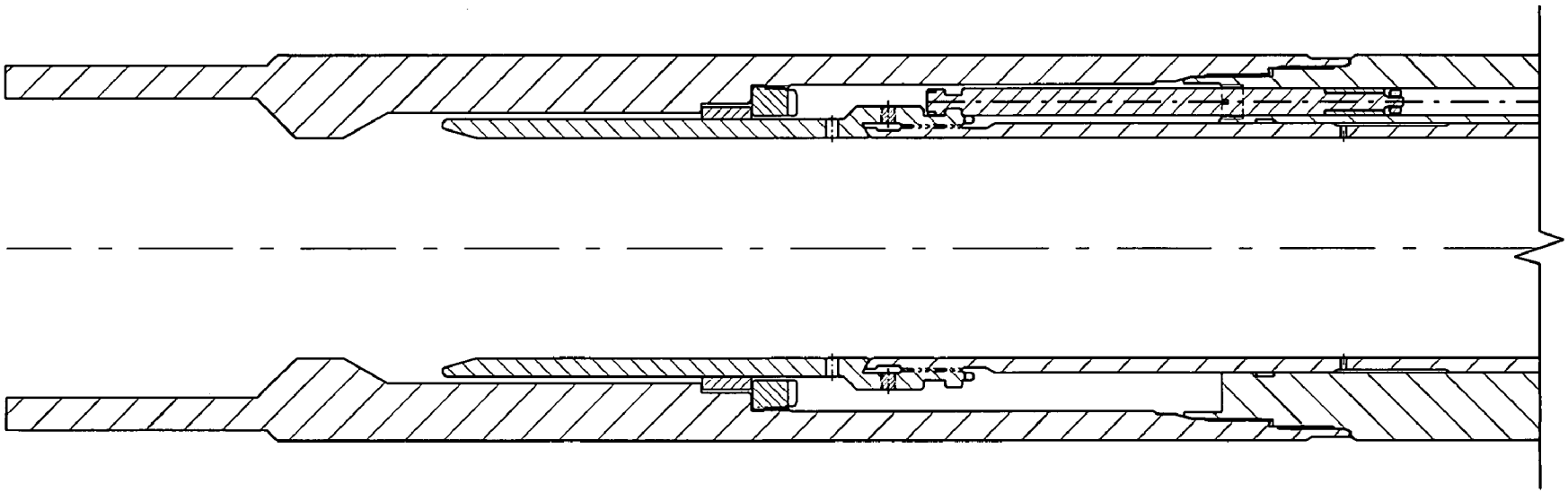
FIGS. 6*a*–6*g* show a split view of an 'RB' Valve using the lock of the present invention with the valve open and locked on one side and at the instant of release on the other.
Figure 6B:
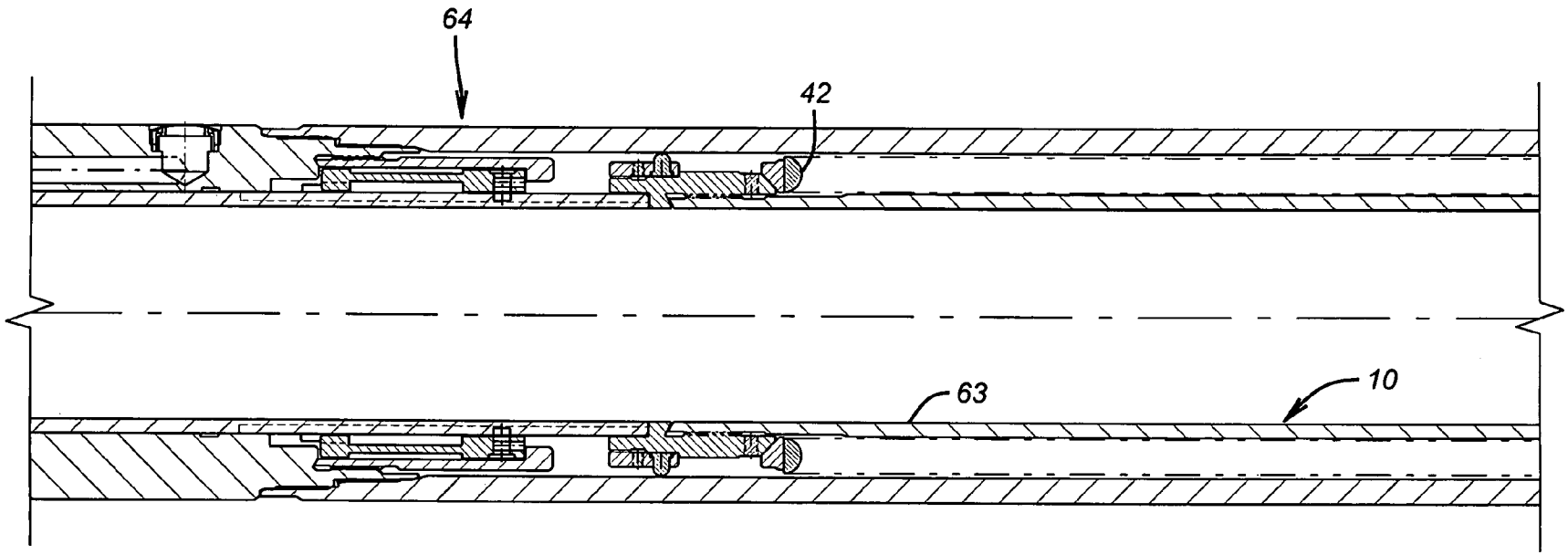
Figure 6C:
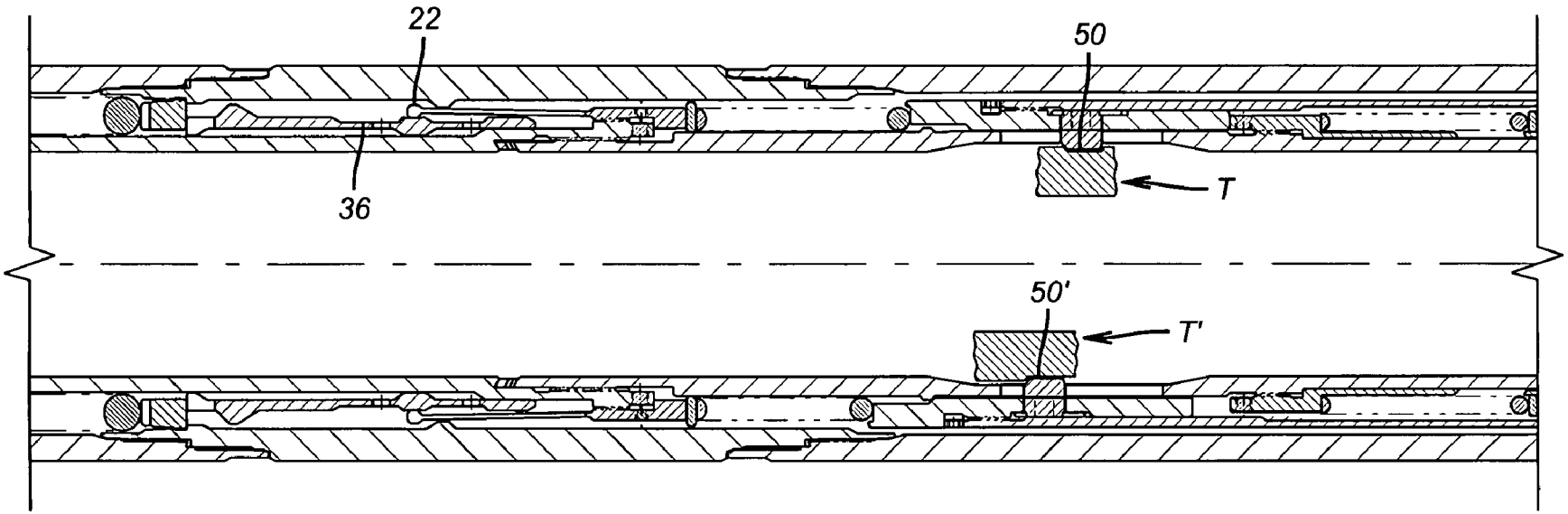
Figure 6D:
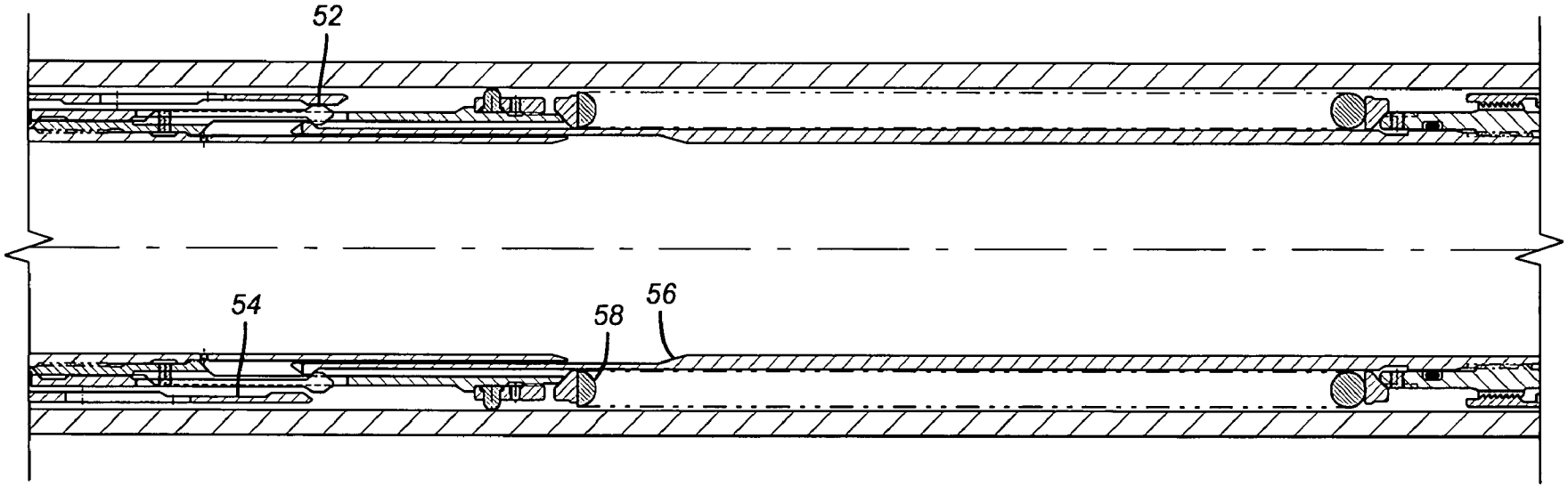
Figure 6E:
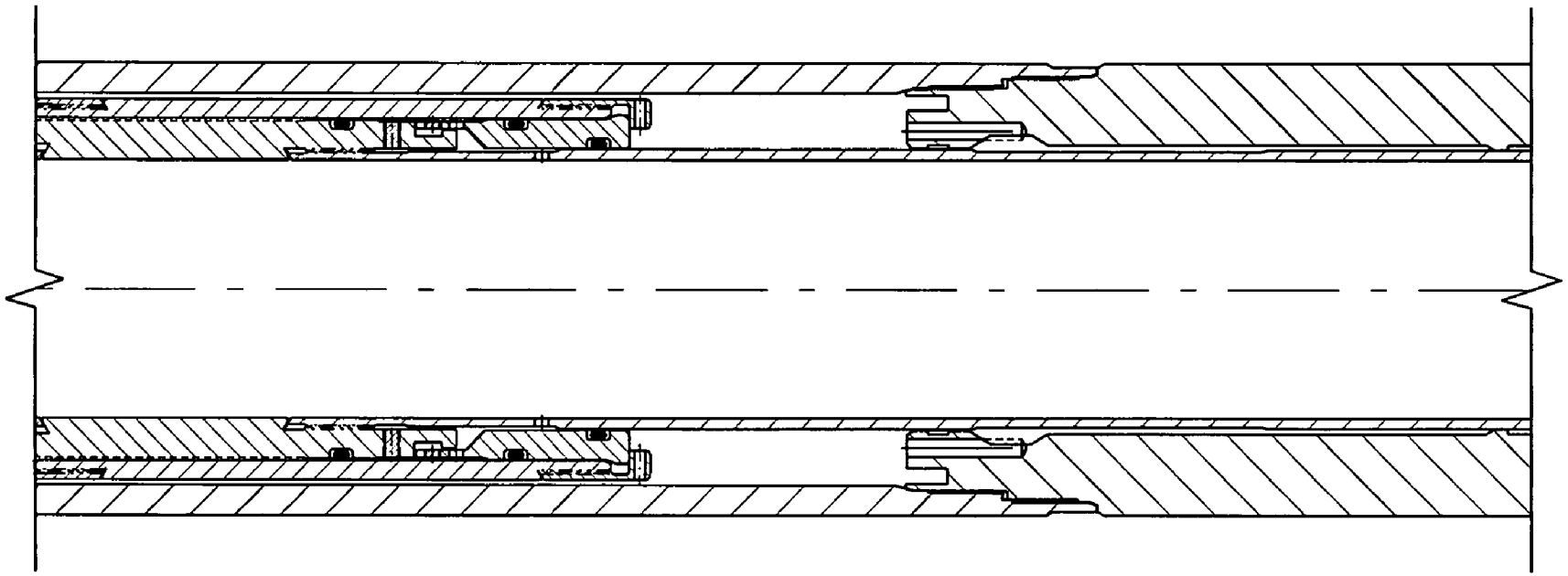
Figure 6F:
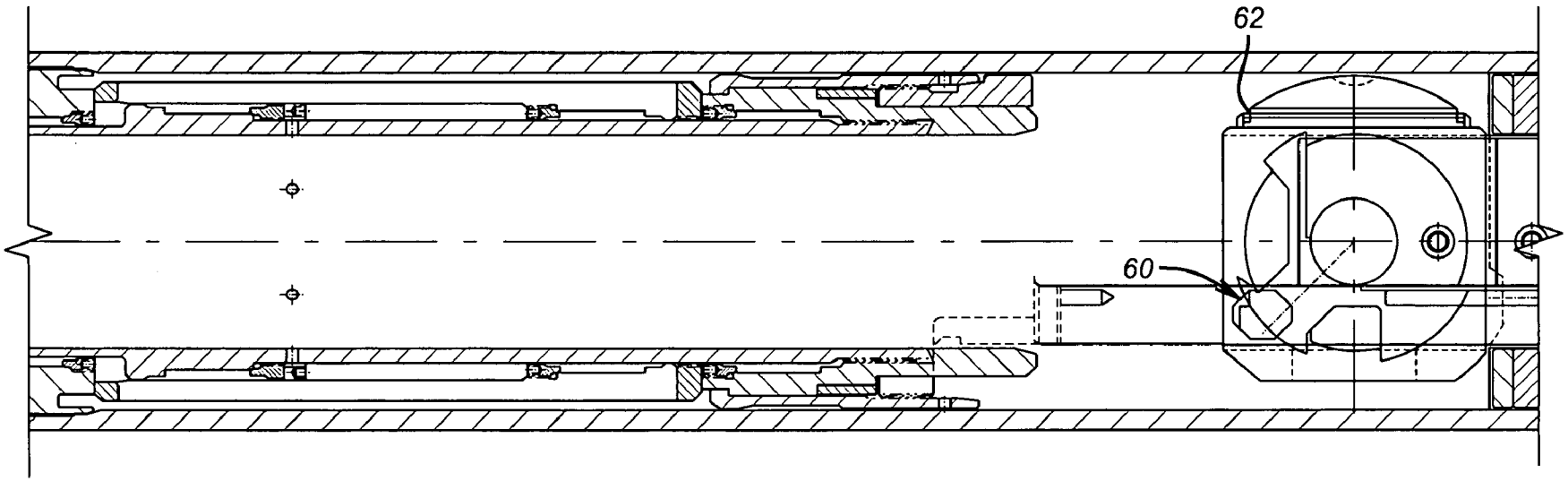
Figure 6G:
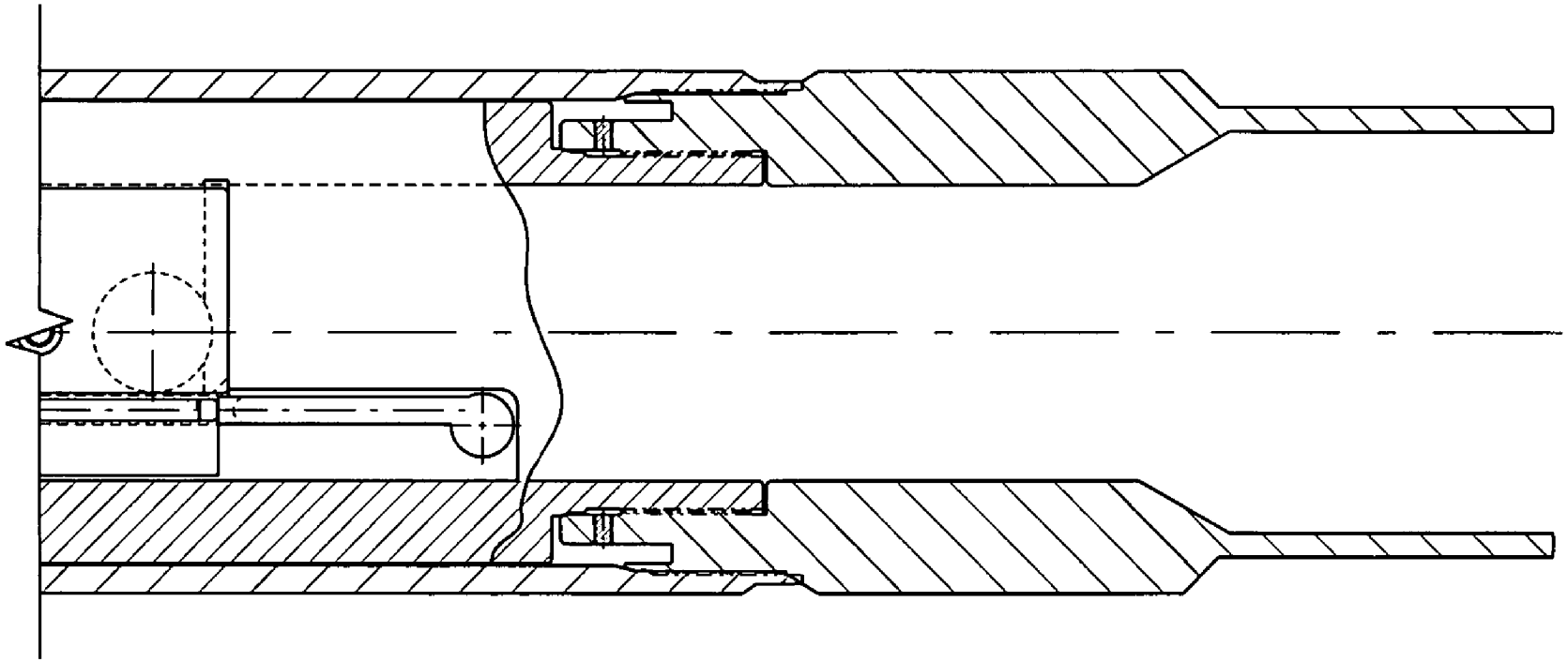

FIG. 4 shows what happens on the last cycle (cycle 12, in the preferred embodiment) where the downhole valve will open. In the first part of this cycle, the tubing pressure is applied forcing the mandrel 10 down. This time the J-slot mechanism (not shown) allows the mandrel 10 to move down further than before. The excess movement of mandrel 10 also means that collet heads 22 move a similar amount. However, the no-goes 32 and 34 contact, preventing downward movement of sleeve 26. As a result the collet heads 22 are pulled down with respect to sleeve 26 until they land in lower groove 38. The collet heads 22 have jumped over the raised groove 40.

When the tubing pressure is released, the J-slot mechanism (not shown) will let the mandrel move uphole under the force of spring 42. The collet heads 22 stay in the lower groove 38 taking the sleeve 26 uphole with mandrel 10. Eventually, after collet heads 22 clear the no-go 34, the sleeve 26 comes up against ring and its upward movement is stopped. However, in this cycle, the J-slot mechanism (not shown) lets the mandrel 10 keep moving up to expand the collet heads 22 apart as they jump up on raised groove 40. This is the position shown in FIG. 5. In this position, the mandrel has moved up enough to open the valve (not shown) and the mandrel 10 is precluded from moving down because collet heads 22 will not clear no-go 34 when on raised groove 40. At the same time, spring 42 keeps the mandrel 10 from moving uphole as the spring force keeps mandrel 10 up against a stop (not shown).

The lock L, in the preferred embodiment, is automatically triggered as the downhole valve goes into the open position. The lock L can be defeated by inserting a tool that extends the mandrel 10 by shifting dogs (not shown) in a manner that lets the lower end of mandrel 10 (not shown) be forced down to close the valve while allowing the portion of mandrel 10 shown in FIG. 5 be biased up by spring 42 with collet heads 22 moving relatively to sleeve 26 so that the collet heads 22 go into upper groove 36 so that the position of FIG. 1 is resumed. The downhole valve can now be cycled the 12 times mentioned before to get it to open and lock open as described above.

The release procedure is illustrated in an 'RB' valve shown in FIG. 6. FIG. 6 is a split view showing the 'RB' valve locked open on one side and at the instant of release on the other. The release is accomplished by an inserted release tool T, shown schematically in the release position as T', that grabs dog 50 shown in FIG. 6*c* and moves it to a position 50'. When that happens, a collet 52 in FIG. 6*d* loses support from sleeve 54 when it moves up with dog 50. The lower portion 56 of mandrel 10 now can be biased down by spring 58 push down the actuating mechanism 60 to rotate ball 62 into the closed position from the open position shown in FIG. 6*f*. At the same time, because collet 52 is undermined, the upper portion 63 of mandrel 10 can be pushed up by spring 42 far enough so that collets 22 can return to upper groove 36. This amount of upward movement is permitted by the J-slot assembly 64. Other release techniques are also envisioned. It should be noted that spring 24 causes collet 52 to be subsequently captured by sleeve 54 as the J-slot mechanism 64 is thereafter cycled to begin the process of reopening the valve.

Those skilled in the art can appreciate that the lock L can be used in a variety of applications downhole where it is desired to temporarily hold a movable member in one position relative to a fixed member. The movable member can be actuated in a variety of ways and can exhibit longitudinal movement, rotational movement or a combination of such movements. The lock can be triggered to come on at predetermined positions of the moving member. This can be made to occur at either extreme of the movement range of the movable member or any point or points in between. The lock L can be automatically deployed at a predetermined position. The lock can preferably be released in a variety of ways and preferably in a non-destructive manner, which will allow it to function again without a trip out of the hole. The lock L is preferably of simple construction to assure reliable operation even in hostile environments. In the preferred embodiment, it requires no pistons or additional seals to be operative. In preferred embodiment, the locking can occur either without rotation of the locking components or, if there is rotation, the locking can occur independently of the degree of rotation of any of the components. While the lock L is particularly suitable for temporarily locking open a downhole valve automatically when it reaches an open position, it can be used in other ways on tester valves or other downhole tools, as partially described above.

The foregoing disclosure and description of the invention are illustrative and explanatory thereof, and various changes in the size, shape and materials, as well as in the details of the illustrated construction, may be made without departing from the invention.

We claim:

1. A lock mechanism for a downhole tool, comprising:

a stationary component and a final controlled element;

a movable component movable with respect to said stationary component and linked to said final controlled element to put said final controlled element in at least two positions;

a lock assembly triggered by a predetermined movement of said movable component that, when actuated, impedes movement of said movable component, despite application of a force or a pattern of forces directly or indirectly to said lock assembly, sufficient to move said final controlled element to the other of said positions.

2. The mechanism of claim 1, wherein:

said lock assembly is automatically triggered when said final controlled element reaches a predetermined position.

3. The mechanism of claim 1, wherein:

said lock assembly comprises a pair of shoulders that can pass by each other until said predetermined movement is reached whereupon a locking member extends at least one of said shoulders to selectively prevent them from passing each other.

4. The mechanism of claim 3, wherein:

said locking member moves relatively to said shoulder that it extends.

5. The mechanism of claim 3, wherein:

said locking member comprises at least one collet mounted to said movable member.

6. The mechanism of claim 3, wherein:

said lock assembly can be released by relative movement between itself and the shoulder that it had extended as a result of a part of said movable component being released to operate said final controlled element into another of its said two positions.

7. A lock mechanism for a downhole tool, comprising:

a stationary component and a final controlled element;

a movable component movable with respect to said stationary component and linked to said final controlled element to put said final controlled element in at least two positions;

a lock assembly triggered by a predetermined movement of said movable component that, when actuated, impedes movement of said final controlled element from one of its said positions into another despite application of a force or a pattern of forces to said lock assembly;

said final controlled element is selectively movable after said lock assembly has been engaged by virtue of relative movement between portions of said movable component with respect to each other.

8. A lock mechanism for a downhole tool, comprising:

a stationary component and a final controlled element;

a movable component movable with respect to said stationary component and linked to said final controlled element to put said final controlled element in at least two positions;

a lock assembly triggered by a predetermined movement of said movable component that, when actuated, impedes movement of said final controlled element from one of its said positions into another despite application of a force or a pattern of forces to said lock assembly;

said lock assembly is automatically triggered when said final controlled element reaches a predetermined position;

said final controlled element is selectively movable after said lock assembly has been engaged by virtue of relative movement between portions of said movable component with respect to each other.

9. A lock mechanism for a downhole tool, comprising:

a stationary component and a final controlled element;

a movable component movable with respect to said stationary component and linked to said final controlled element to put said final controlled element in at least two positions;

a lock assembly triggered by a predetermined movement of said movable component that acts to impede movement of said movable component with respect to said stationary component;

said lock assembly comprises a pair of shoulders that can pass by each other until said predetermined movement is reached whereupon a locking member extends at least one of said shoulders to selectively prevent them from passing each other;

said locking member moves relatively to said shoulder that it extends;

said locking member comprises at least one collet mounted to said movable member;

said shoulder that is extended comprises a raised surface disposed between an upper and a lower recessed surfaces and said other of said shoulders comprises a no-go shoulder on said stationary component;

said collet clearing said no-go shoulder when positioned in said recessed surfaces.

10. The mechanism of claim 9, wherein:

said collet, when on said raised surface, engaging said no-go shoulder to impede movement of said movable component.

11. The mechanism of claim 10, wherein:

said raised and recessed surfaces are disposed on a sleeve that is mounted for relative movement with respect to said movable component.

12. The mechanism of claim 11, wherein:

said sleeve comprising a second no-go shoulder to selectively engage said no-go shoulder on said stationary component to alter the position of said collet with respect to said sleeve when said predetermined movement is made.

13. The mechanism of claim 12, wherein:

said predetermined movement comprises opposed movements of said movable component comprising a first movement where said no-go on said sleeve engages said no-go on said stationary component, while said movable component continues to move, to shift said collet to said lower recessed surface and a second movement of said movable component opposite to said first movement where said collet passes said no-go on said stationary component and ends up on said raised surface.

14. The mechanism of claim 13, wherein:

said sleeve is urged to move during said second movement of said movable component until movement of said sleeve is stopped by said stationary component to allow said collets to move relatively to said sleeve and wind up on said raised surface.

15. The mechanism of claim 14, wherein:

said collet is selectively repositioned from a locked position on said raised surface to an unlocked position on a recessed surface as said final controlled element is urged into another of said two positions.

16. A lock assembly for a downhole valve, comprising:

a stationary housing;

a mandrel movably mounted with respect to said housing and connected to a valve member to selectively open and close said valve member in response to a predetermined movement of said mandrel;

a lock that automatically engages said mandrel when said valve member reaches one of said open and closed positions, said lock not defeated by a force or a pattern of forces applied to it when set, said valve member selectively movable to the other of said open and closed positions with a first portion of said mandrel after said first portion is released from a second portion for relative movement therebetween.

17. The assembly of claim 16, wherein:

said lock selectively retains said mandrel to said stationary housing.

18. A lock assembly for a downhole valve, comprising:

a stationary housing;

a mandrel movably mounted with respect to said housing and connected to a valve member to selectively open and close said valve member in response to a predetermined movement of said mandrel;

a lock that automatically engages said mandrel when said valve member reaches one of said open and closed positions, said lock selectively defeated to allow movement of said valve member to the other of said open and closed positions;

said lock selectively retains said mandrel to said stationary housing;

said lock comprises a collet connected to said mandrel and a sleeve movably mounted over said mandrel and further comprising a raised surface;

said housing comprising an internal no-go shoulder;

said lock operative to retain said mandrel to said internal no-go shoulder of said housing when said collet aligns with said raised surface on said sleeve.

19. The assembly of claim 18, wherein:

said sleeve comprises at least one recessed surface, said collet clearing past said internal no-go shoulder when aligned with said recessed surface.

20. The assembly of claim 19, wherein:

said at least one recessed surface on said sleeve comprises an upper and lower recessed surfaces respectively above and below said raised surface;

said sleeve further comprises a second no-go shoulder such that movement of said mandrel with said no go shoulders in contact moves said collet from said upper to said lower recessed surface, whereupon reversal of mandrel movement direction said collet clears said internal no-go shoulder and said sleeve movement is stopped allowing said collet to ride up to said raised surface to lock said mandrel to said housing.

* * * * *